US007762033B2

(12) United States Patent
Scott et al.

(10) Patent No.: US 7,762,033 B2
(45) Date of Patent: Jul. 27, 2010

(54) WALL CONSTRUCTION SYSTEM AND METHOD

(76) Inventors: Robert E. Scott, 6625 Calle Betelgeux, Tucson, AZ (US) 85710; Jason E. Scott, P.O. Box 6727, Nogales, AZ (US) 85628

( * ) Notice: Subject to any disclaimer, the term of this patent is extended or adjusted under 35 U.S.C. 154(b) by 1106 days.

(21) Appl. No.: 11/393,150

(22) Filed: Mar. 29, 2006

(65) Prior Publication Data

US 2007/0245660 A1 Oct. 25, 2007

(51) Int. Cl.
*E04B 2/00* (2006.01)

(52) U.S. Cl. ..... 52/425; 52/745.09; 52/285.3; 52/293.3; 52/274; 52/565; 52/426; 52/745.1; 52/431; 52/432

(58) Field of Classification Search ..... 52/309.1, 52/309.12, 425, 426, 285.3, 293.1, 293.2, 52/293.3, 395, 374, 431, 432, 656, 605, 606, 52/586.1, 745.09, 745.1
See application file for complete search history.

(56) References Cited

U.S. PATENT DOCUMENTS

| | | | | | |
|---|---|---|---|---|---|
| 835,769 | A | * | 11/1906 | Wiederholdt | 52/293.2 |
| 839,015 | A | * | 12/1906 | Loomis | 52/243 |
| 1,127,058 | A | * | 2/1915 | Marshall | 52/479 |
| 1,185,969 | A | * | 6/1916 | Blackstone | 52/293.2 |
| 1,420,478 | A | * | 6/1922 | Forbush | 52/426 |
| 1,499,483 | A | * | 7/1924 | Simms | 52/436 |
| 1,596,404 | A | * | 8/1926 | Clouser | 52/562 |
| 1,719,782 | A | * | 7/1929 | Roberts, Jr. et al. | 52/258 |
| 2,029,082 | A | * | 1/1936 | Odam | 52/275 |
| 2,106,177 | A | * | 1/1938 | Hultquist | 52/438 |
| 2,141,397 | A | * | 12/1938 | Locke | 52/204.2 |
| 2,250,763 | A | * | 7/1941 | Hild | 52/279 |
| 2,392,551 | A | * | 1/1946 | Roe | 52/586.2 |
| 2,518,186 | A | * | 8/1950 | Rumble | 52/234 |
| 2,676,482 | A | * | 4/1954 | Wilson | 52/564 |
| 2,851,875 | A | * | 9/1958 | Astorga | 52/289 |
| 3,318,059 | A | * | 5/1967 | Wright | 52/169.9 |
| 3,410,044 | A | * | 11/1968 | Moog | 52/309.12 |
| 3,511,000 | A | * | 5/1970 | Keuls | 52/126.4 |
| 3,683,575 | A | * | 8/1972 | Meziere | 52/241 |
| 3,788,020 | A | * | 1/1974 | Gregori | 52/309.12 |
| 3,805,471 | A | * | 4/1974 | De Schutter | 52/714 |
| 3,818,665 | A | * | 6/1974 | Rogers, Jr. | 52/375 |

(Continued)

FOREIGN PATENT DOCUMENTS

EP 174882 A1 * 3/1986

*Primary Examiner*—Robert J Canfield
*Assistant Examiner*—Matthew J Gitlin
(74) *Attorney, Agent, or Firm*—Timothy M. Barlow

(57) ABSTRACT

A wall construction system includes a footer attached to a floor or footer; vertical reinforcing bars attached to the footer; horizontal reinforcing bars attached to vertical reinforcing bars at predetermined heights above the footer; blocks attached onto the footer, each layer including a row of blocks, each block including a pair of flat major surfaces and four contoured minor surfaces, and a plurality of longitudinal grooves parallel to the major surfaces and incorporated into the edges of the minor surfaces; a plurality of joining strips, the strips placed end to end and pressed into each longitudinal groove, with about half their width protruding from the longitudinal grooves; a plurality of lateral clips attached to pairs of joining strips across the top of the blocks, perpendicular to the longitudinal grooves; and a quantity of concrete in horizontal and vertical air gaps between adjacent blocks enveloping horizontal and vertical reinforcing bars.

19 Claims, 4 Drawing Sheets

U.S. PATENT DOCUMENTS 4,034,529 A * 7/1977 Lampus ..... 52/426
4,038,798 A * 8/1977 Sachs ..... 52/309.7
4,190,999 A * 3/1980 Hampton ..... 52/687
4,229,922 A * 10/1980 Clark, Jr. ..... 52/442
4,321,779 A * 3/1982 Kratchmer ..... 52/425
4,324,080 A * 4/1982 Mullins ..... 52/309.12
4,433,520 A * 2/1984 Maschhoff ..... 52/275
4,486,993 A * 12/1984 Graham et al. ..... 52/262
4,514,949 A * 5/1985 Crespo ..... 52/603
4,532,745 A * 8/1985 Kinard ..... 52/251
4,577,447 A * 3/1986 Doran ..... 52/571
4,604,843 A * 8/1986 Ott et al. ..... 52/426
4,698,947 A * 10/1987 McKay ..... 52/309.12
4,835,928 A * 6/1989 Scott ..... 52/426
4,888,931 A * 12/1989 Meilleur ..... 52/426
5,072,556 A * 12/1991 Egenhoefer ..... 52/126.4
5,367,845 A * 11/1994 Hartling ..... 52/293.1
5,371,990 A * 12/1994 SalahUddin ..... 52/379
5,488,806 A * 2/1996 Melnick et al. ..... 52/425
5,598,675 A * 2/1997 Pruss ..... 52/309.4
5,704,180 A * 1/1998 Boeck ..... 52/426
5,720,138 A * 2/1998 Johnson ..... 52/220.7
5,771,654 A * 6/1998 Moore et al. ..... 52/742.14
5,839,243 A * 11/1998 Martin ..... 52/439
5,839,249 A * 11/1998 Roberts ..... 52/745.08
5,855,102 A * 1/1999 Chang ..... 52/604
5,878,544 A * 3/1999 McKinnon ..... 52/566
5,881,524 A * 3/1999 Ellison, Jr. ..... 52/565
5,890,332 A * 4/1999 Skidmore et al. ..... 52/271
5,992,109 A * 11/1999 Jonker ..... 52/238.1
6,018,922 A * 2/2000 McKinnon ..... 52/700
6,085,476 A * 7/2000 Jantzi et al. ..... 52/223.7
6,138,426 A * 10/2000 Mork et al. ..... 52/562
6,164,035 A * 12/2000 Roberts ..... 52/563
6,189,282 B1 * 2/2001 VanderWerf ..... 52/582.1
6,212,844 B1 * 4/2001 Lange ..... 52/563
6,256,960 B1 * 7/2001 Babcock et al. ..... 52/592.1
6,321,498 B1 * 11/2001 Trovato ..... 52/426
6,405,505 B1 * 6/2002 Alberti ..... 52/562
6,474,033 B1 * 11/2002 Luchini et al. ..... 52/426
6,721,684 B1 * 4/2004 Saebi ..... 702/183
6,739,102 B2 * 5/2004 Roy, Sr. ..... 52/294
6,832,456 B1 * 12/2004 Bilowol ..... 52/426
6,840,019 B2 * 1/2005 Berg ..... 52/687
6,883,281 B1 * 4/2005 Chavez-Gandara ..... 52/284
6,898,912 B2 * 5/2005 Bravinski ..... 52/426
7,415,805 B2 * 8/2008 Nickerson ..... 52/426
7,546,716 B1 * 6/2009 Asadurian ..... 52/570
2002/0017070 A1 * 2/2002 Batch ..... 52/309.11
2002/0043038 A1 * 4/2002 Cerrato ..... 52/604
2002/0059773 A1 * 5/2002 Elderson ..... 52/667
2003/0029107 A1 * 2/2003 Ritter et al. ..... 52/309.11
2003/0070383 A1 * 4/2003 Heinle ..... 52/582.1

* cited by examiner

WALL CONSTRUCTION SYSTEM AND METHOD

FIELD OF THE INVENTION

The present invention relates generally to the field of building construction systems and more particularly to a wall construction system and method.

BACKGROUND OF THE INVENTION

We depend upon modern building construction to solve many of the problems of our daily lives. We expect our buildings to be much more energy-efficient than in the past. In addition, we value privacy and entertainment, so we want our buildings to complement those parts of our lifestyles. High-powered audio-visual and entertainment systems can easily be heard in adjacent rooms and throughout a house or other building. Office discussions are more frequently subject to eavesdropping and other privacy concerns. Sound-control is a top priority for many individuals and businesses. More and more is demanded of our buildings, whether office buildings and other commercial workplaces or homes.

Thus, what is desired is a wall construction system that provides superior thermal, acoustic and strength characteristics, and is also very simple to build.

SUMMARY OF INVENTION

A wall construction system includes a footer attached to a floor. A plurality of blocks, such as foam or plastic blocks, are stacked to create one or more walls. The shape of the blocks creates a series of vertical and horizontal channels through the stacked blocks. A plurality of vertical reinforcing bars are attached to the floor, and horizontal reinforcing bars are attached to the vertical reinforcing bars between the layers of blocks. Each block includes a plurality of longitudinal grooves that accept a plurality of joining strips to align the blocks and hold them in place. A plurality of lateral clips is attached to a pair of joining strips and across the top of each block, perpendicular to the longitudinal grooves. The entire assembly is filled with a quantity of concrete to envelope the horizontal and vertical reinforcing bars.

DETAILED DESCRIPTION OF THE DRAWINGS

Figure 1:
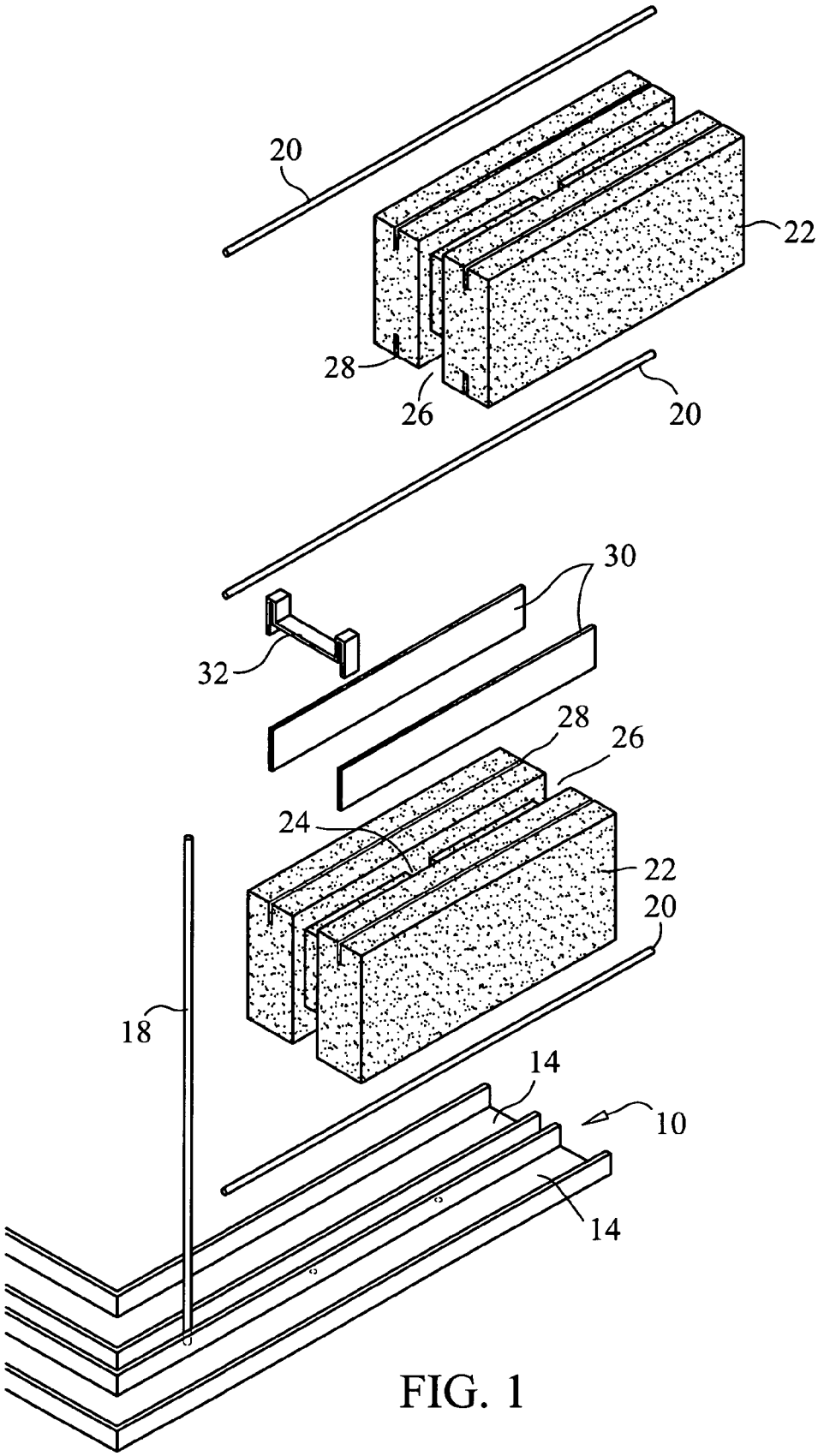
FIG. 1 is a perspective view of a disassembled wall construction system, in accordance with the present invention.

FIG. 1 shows a perspective view of a disassembled wall construction system. The foundation of the wall construction system is the footer 10. The footer 10 is placed against the floor and provides attachment points for the first layer of the wall. The footer 10 includes a pair of parallel U-shaped channels 14 that bare secured directly to the floor. The channels 14 can be a sheet metal stamping or other durable materials. The footer 10 can be angled or mitered to create corners or other features common to building and wall construction.

A plurality of vertical reinforcing bars 18 extend upward from the floor between the channels 14. The vertical bars 18 may be incorporated directly into the floor, such as a concrete slab, for maximum stability of the finished wall. The spacing of the vertical bars 18 can conform to local building codes or other conventions. For example, the spacing between the vertical bars 18 can be 16 inches.

The wall construction system includes a plurality of horizontal reinforcing bars 20, construction blocks 22, joining strips 30, and lateral clips 32.

Figure 2:
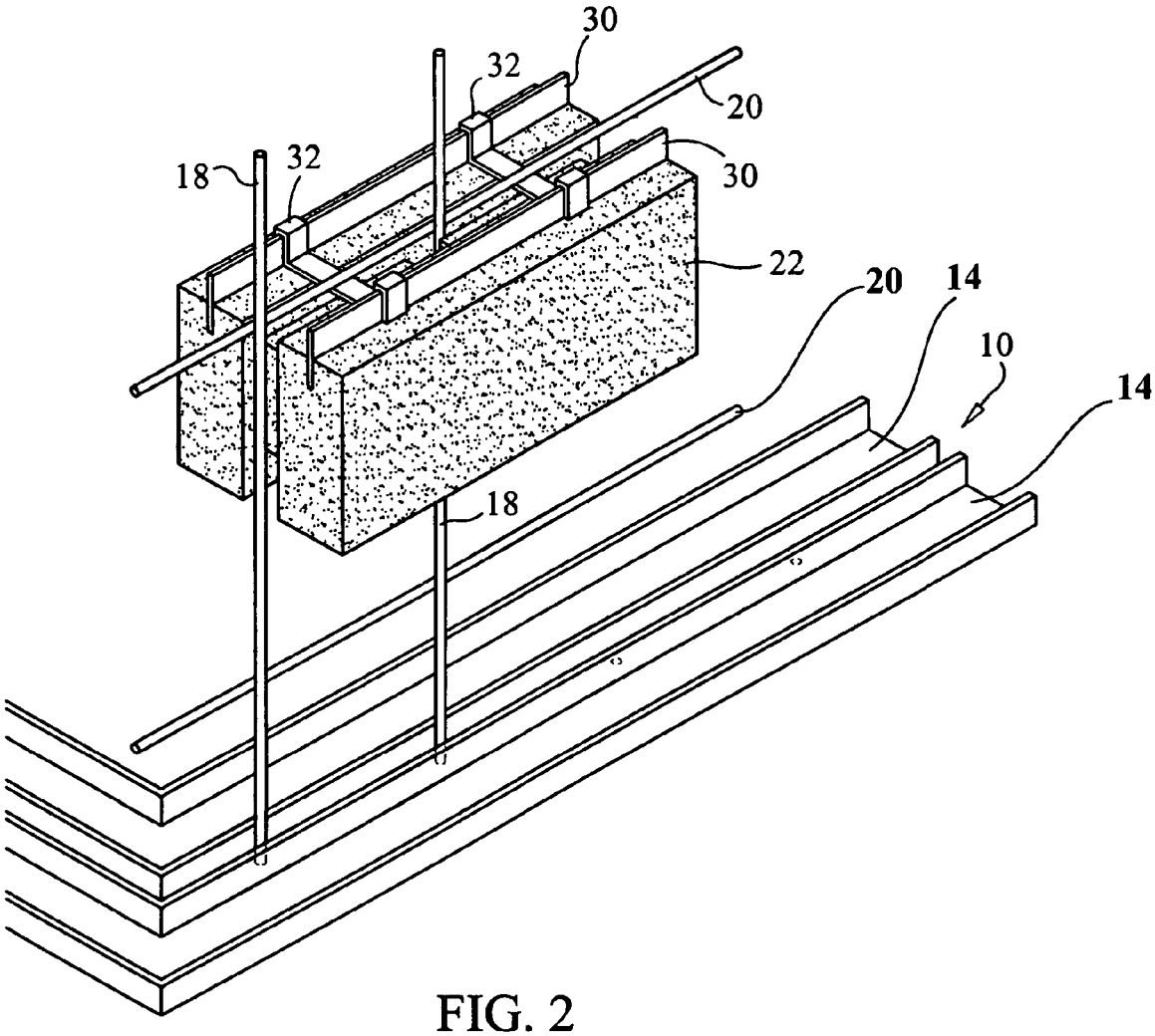
FIG. 2 is a perspective view of the wall construction system, in accordance with the present invention.

FIG. 2 shows a perspective view of the wall construction system with a single block 22. A pair of vertical bars 18 are shown in FIG. 2, with a first layer of horizontal bars 20 attached to each of the vertical bars 18 above the footer 10. It is preferred that the horizontal bars 20 do not contact the footer 10 directly. Instead, the horizontal bars 20 are separated from the footer 10 with shims and then wired into place. When the horizontal bars 20 are properly secured to the vertical bars 18, the shims can be removed to provide a gap between the horizontal bars 20 and the footer 10.

Figure 3:
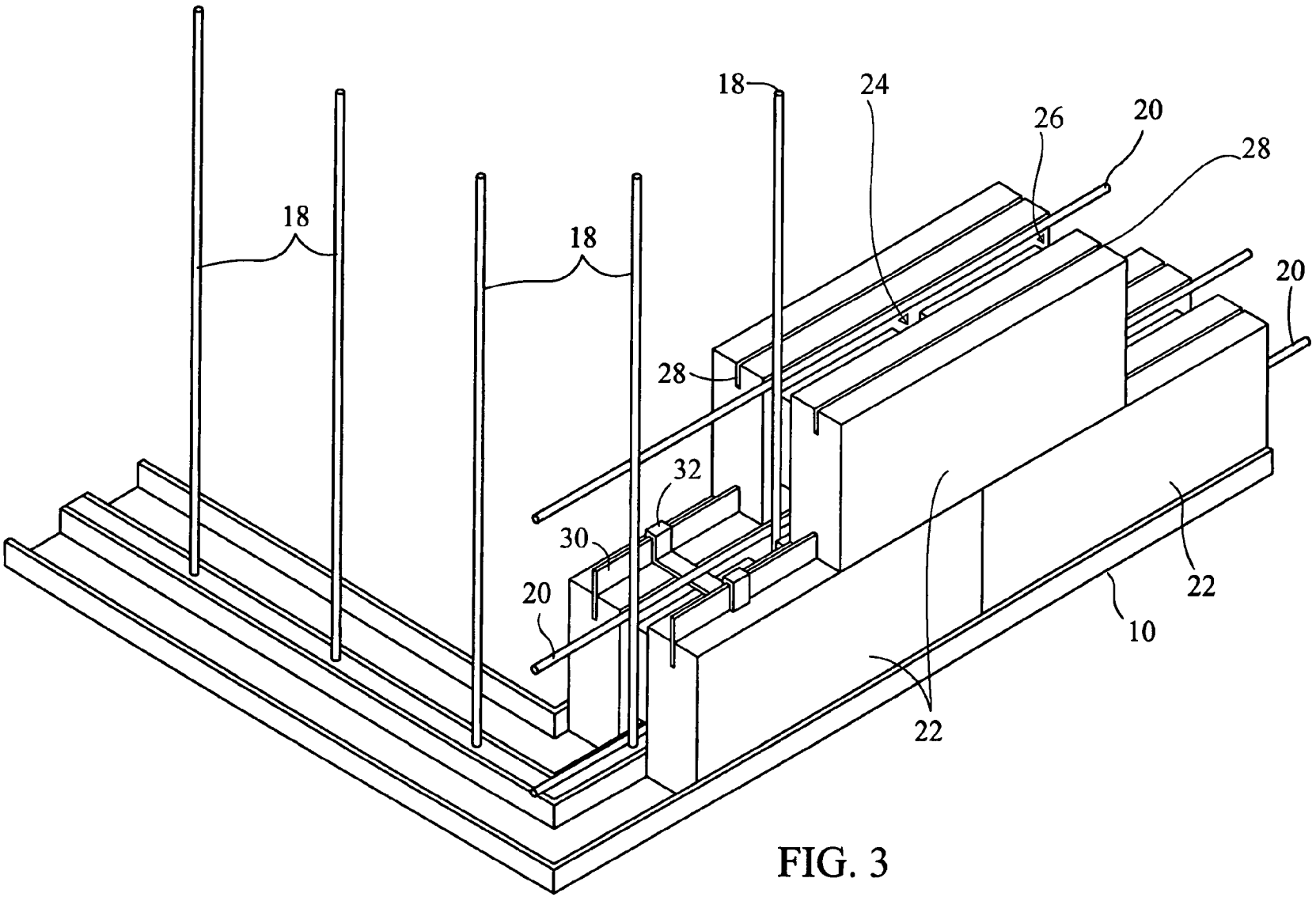
FIG. 3 is a perspective view of a partially assembled wall construction system, in accordance with the present invention.

FIG. 3 shows three blocks 22 creating a partially assembled wall. The plurality of blocks 22 in the first layer are placed into and onto the footer 10. The unique construction of the blocks 22 permits this arrangement. The blocks 22 have continuous channel or groove 34 around their top, bottom and sides. The major surfaces of the blocks 22 facing the outside of the wall are not contoured and are substantially smooth. Each block 22 also includes one or more vertical holes 24 completely contained within the block 22. A vertical half-hole 26 is located at the side edges that butt against other blocks 22. When the wall is assembled, the half-holes 26 are a part of the continuous channel 34 around each block 22. When a plurality of blocks 22 are formed into a layer, two half-holes 26 butt against each other to form one complete new vertical hole. The spacing between a vertical hole 24 and the adjacent vertical hole 24 or pair of half-holes 26 matches the spacing of the footer holes 16 and the vertical bars 18.

Each block 22 is placed onto the footer 10 so that the continuous channel or groove 34 around the block 22 is centered over and parallel to the footer 10. The horizontal bar 20 of the first layer is approximately centered between the blocks 22 and the footer 10. When the plurality of blocks 22 for the first layer is completed, a plurality of joining strips 30 are pressed into the longitudinal grooves 28 along the top and bottom edges of each block 22. The strips 30 can be a single piece of an extruded material or plastic or metal sheet that is unrolled and cut to length. A single strip 30 can run the entire length of the wall. Alternatively, precut strips 30 can be manufactured in standard lengths and packaged for use on the job site. The strips 30 are approximately twice as high as the depth of each longitudinal groove 28. Thus, about half of each strip 30 protrudes above the top of each block 22. Next, a plurality of lateral clips 32 are placed across the tops of each block 22 and attached to the parallel strips 30 to join the parallel strips 30 together. The plurality of lateral clips 32 form a bridge along the tops of the blocks 22 of that layer. A subsequent layer of horizontal bars 20 is placed across the plurality of lateral clips 32, against the vertical bars 18 and approximately centered between the strips 30. The lateral clips 32 suspend the horizontal bars 20 above the continuous channel 34 along the top of the plurality of blocks 22 so that the horizontal bars 20 can be easily secured to the vertical bars 18. Typically, only one lateral clip 32 is required between each vertical bar 18. The lateral clips 32 provide some lateral support of the joining strips 30 and also support the horizontal bars 20 until they are secured to the vertical bars 18.

When the horizontal bars 20 are secured to the vertical bars 18, that layer is finished and the wall is ready for the next layer of blocks 22. As explained earlier, each block 22 includes a number of longitudinal grooves 28 along the top and bottom edges. The blocks 22 of the next layer are pressed down onto the strips 30 protruding from the top of the blocks 22 in the previous layer. The blocks 22 are placed in a staggered formation atop the previous layer to minimize the number of seams that align, similar to common masonry construction. The blocks 22 are somewhat deformable, allowing the grooves 28 to accommodate the multiple layers and various thicknesses of strips 30 and clips 32.

The construction process continues with subsequent application of strips 30, clips 32, horizontal bars 20 and blocks 22 until the wall is the desired size. Electrical conduit, cables 40, plumbing and other materials may be incorporated into the wall as it is built. This eliminates the necessity of making holes in the blocks 22 after construction is completed.

Upon completion of the wall, the continuous horizontal and vertical channels 34 through and around the blocks 22 can be filled with a slurry of concrete, surrounding the horizontal bars 20 and vertical bars 18 with concrete and providing exceptional strength properties to the wall. The blocks 22 may be made from a lightweight foam, such as polystyrene, or other suitable materials. Such construction methods and materials result in a wall with outstanding acoustic and thermal insulation properties as well as exceptional strength. In addition, the blocks 22 may be made on the job site, eliminating the need to transport heavy bricks. The blocks 22 may be made in any desired length to minimize the number of vertical seams, or may be a standard size to simplify the manufacturing and construction process. The blocks 22 may also be made from multiple smaller blocks that are glued or bonded together.

Figure 4:
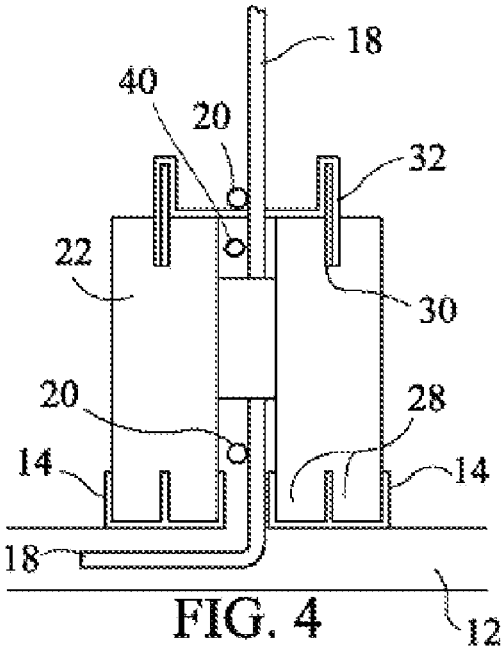
FIG. 4 is an end view of a wall block and associated hardware for the wall construction system, according to the present invention.
Figure 5:
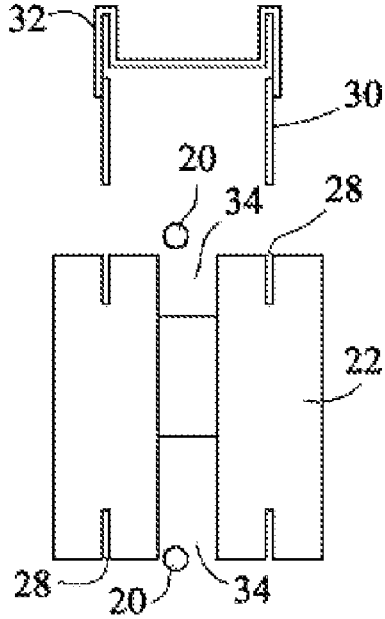
FIG. 5 is an end view of the wall block and associated hardware for the wall construction system, according to the present invention.
Figure 6:
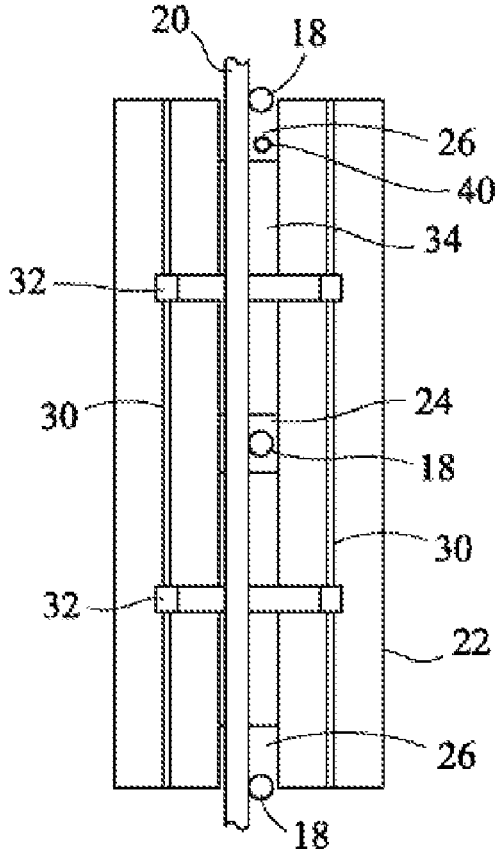
FIG. 6 is a top view of the wall construction system, according to the present invention.

FIGS. 4-6 are end and top views of partially assembled wall block 22 with the associated hardware. The block 22 has a generally H-shaped profile and includes a continuous channel 34 around the top, ends and bottom. The top and bottom parts of the channel 34 are visible in this view in FIGS. 4 and 5. The block engages the U-shaped channels 14 of the footer. The vertical bars 18 are shown incorporated directly into the floor 12. The block 22 is shown with four longitudinal grooves 28. FIG. 4 shows the upper two longitudinal grooves 28 with joining strips 30 inserted. The joining strips 30 are approximately twice the height of each longitudinal groove 28. A lateral strip 32 attaches across the top of the block to the two parallel joining strips 30. The lateral strip 30 provides a support position for a horizontal bar 20. In an assembled wall, the horizontal bar 20 is enclosed within the continuous channel 34.

FIG. 5 shows an end view of a disassembled wall block 22 with its associated hardware. Their proper orientation is shown. The vertical holes 24 include a vertical bar 18 that extends up from the footer 10. The vertical bars 18 are attached to the horizontal bars 20 at each of their intersections. FIG. 6 is a top view of an assembled block 22 for the wall system. The lateral clips 32 are shown beneath and supporting the horizontal bar 20.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A wall construction system comprising:

a footer attached to a floor;

a plurality of vertical reinforcing bars attached to at least one of the floor and the footer;

a first layer of horizontal reinforcing bars attached to the vertical reinforcing bars at a predetermined height above the footer;

a plurality of layers of blocks attached onto the footer, wherein each layer of blocks includes a row of blocks, each of the blocks further comprising a pair of substantially flat major surfaces and four contoured minor surfaces, and a plurality of longitudinal grooves that are parallel to the major surfaces and incorporated into the edges of the minor surfaces, the blocks having a generally H-shaped profile when viewed perpendicular to the major surfaces, the H-shape providing a continuous channel around the top, ends and bottom of each block;

a plurality of joining strips, the strips placed end to end and pressed into each longitudinal groove, with about half their width protruding from the longitudinal grooves;

a plurality of lateral clips attached to a pair of joining strips and across the top of the blocks, perpendicular to the longitudinal grooves, wherein each reinforcing bar is approximately centered within the continuous channel formed between the adjacent blocks, both horizontally and vertically; and a quantity of concrete poured into the horizontal and vertical channels between adjacent blocks to envelope the horizontal and vertical reinforcing bars.

2. The wall construction system of claim 1, where the footer comprises a pair of U-shaped metal channels.

3. The wall construction system of claim 1, where the floor comprises a plurality of regularly-spaced vertical holes.

4. The wall construction system of claim 3, where a plurality of vertical reinforcing bars are inserted into the regularly-spaced holes in the footer.

5. The wall construction system of claim 1, the blocks comprising a rectangular profile from the two major sides and an H-shaped profile when viewed from the top, bottom and minor sides.

6. The wall construction system of claim 2, where the blocks are pressed into the U-shaped channels of the footer, the blocks comprising an air gap around the reinforcing bar, both horizontally and vertically.

7. The wall construction system of claim 1, where the blocks are attached to each other with a construction adhesive.

8. The wall construction system of claim 1, where the blocks are made of an expanded foam.

9. The wall construction system of claim 1, where the blocks are made of a plastic having exceptional structural, thermal and acoustic properties.

10. The wall construction system of claim 1, further comprising a sheathed cable or electrical conduit incorporated into the air gap.

11. A wall construction system comprising:

a plurality of layers of wall blocks, each layer including a row of blocks, each of the blocks further comprising a pair of substantially flat major surfaces and four contoured minor surfaces, the blocks having a generally H-shaped profile when viewed perpendicular to the major surfaces, the H-shape providing a channel around the top, ends and bottom of each block, and a plurality of longitudinal grooves that are parallel to the major surfaces and incorporated into the edges of the minor surfaces, wherein adjacent blocks form a continuous channel, the continuous channel arranged both horizontally and vertically between adjacent blocks;

a plurality of joining strips, the strips placed end to end and pressed into each longitudinal groove, with about half their width protruding from the longitudinal grooves;

a plurality of lateral clips attached to a pair of joining strips and across the top of the blocks, perpendicular to the longitudinal grooves;

a vertical reinforcing bar approximately centered within each of the vertical channels;

a layer of horizontal reinforcing bar laid across the lateral clips and approximately centered within the horizontal channels and attached to each of the vertical reinforcing bars; and a quantity of concrete poured into the horizontal and vertical channels between adjacent blocks to envelope the horizontal and vertical reinforcing bars.

12. The wall construction system of claim 11, further comprising:

a footer attached to a floor, onto which the first layer of a plurality of wall blocks is attached.

13. The wall construction system of claim 12, where the plurality of vertical reinforcing bars is attached to the footer.

14. The wall construction system of claim 13, where the first layer of horizontal reinforcing bars is attached to the vertical reinforcing bars at a predetermined height above the footer.

15. A method for constructing a wall with superior thermal, acoustic and strength properties, comprising the steps of:

(a) securing a footer to a floor;

(b) creating a plurality of regularly-spaced vertical holes into the floor;

(c) inserting a vertical reinforcement bar into each vertical hole in the floor;

(d) attaching a layer of horizontal reinforcement bars to each vertical reinforcement bar;

(e) placing a first layer of blocks onto the footer and around the vertical reinforcement bars, wherein each layer of blocks includes a row of blocks, each of the blocks further comprising a pair of substantially flat major surfaces and four contoured minor surfaces, and a plurality of longitudinal grooves that are parallel to the major surfaces and incorporated into the edges of the minor surfaces, the blocks having a generally H-shaped profile when viewed perpendicular to the major surfaces, the H-shape providing a continuous channel around the top, ends and bottom of each block;

(f) inserting a plurality of joining strips into a pair of longitudinal slits along the top edges of the wall blocks with an upper half of the strips exposed above the wall blocks;

(g) attaching a lateral clip across the top of each wall block onto the pair of joining strips on each wall block;

(h) placing a next layer of horizontal reinforcement bars across the lateral clips and against the vertical reinforcement bars;

(i) attaching the next layer of horizontal reinforcement bars to the vertical reinforcement bars;

(j) placing a next layer of wall blocks onto the first layer of wall blocks;

(k) engaging the next layer of blocks onto the strips and clips (l) creating a plurality of horizontal and vertical air channels around the horizontal and vertical reinforcement bars, wherein each reinforcing bar is approximately centered within the continuous channel formed between adjacent blocks, both horizontally and vertically; and (m) enveloping the reinforcement bars within the air channels with concrete.

16. The method for constructing a wall of claim 15, where step (d) further comprises the step of:

(d1) fixing the horizontal reinforcement bars a predetermined distance above the footer.

17. The method for constructing a wall of claim 15, where step (e) further comprises the step of:

(e1) fixing the abutting ends of the blocks together.

18. The method for constructing a wall of claim 15, where step (h) further comprises the step of:

(h1) routing a conduit through the blocks adjacent to the horizontal and vertical reinforcement bars.

19. The method for constructing a wall of claim 15, where step (k) further comprises the step of:

(k1) fixing the abutting ends of the blocks together.

* * * * *